US006257242B1

(12) United States Patent
Stavridis

(10) Patent No.: US 6,257,242 B1
(45) Date of Patent: Jul. 10, 2001

(54) FILTER ELEMENT

(76) Inventor: Ioannis C. Stavridis, 15 Chremonidou St., GR-166 33, Athens (GR)

( * ) Notice: Subject to any disclaimer, the term of this patent is extended or adjusted under 35 U.S.C. 154(b) by 0 days.

(21) Appl. No.: 09/420,359

(22) Filed: Oct. 18, 1999

(51) Int. Cl.[7] ..... A24D 3/04; A24B 15/00; B01J 20/02; B01D 53/02

(52) U.S. Cl. ..... 131/344; 131/341; 131/342; 131/331; 502/416; 502/417; 96/134; 55/350.1

(58) Field of Search ..... 131/331, 341, 131/342, 344; 502/416, 417; 95/274; 96/134; 55/350.1

(56) References Cited

U.S. PATENT DOCUMENTS

| | | |
|---|---|---|
| 3,557,801 | 1/1971 | Jamison . |
| 3,972,335 | 8/1976 | Tiggelbeck et al. . |
| 4,116,602 | 9/1978 | Hall . |
| 4,260,523 | 4/1981 | Tsukamoto . |
| 4,641,666 | 2/1987 | O'Connell, Sr. . |
| 5,360,023 | 11/1994 | Blakley et al. . |
| 5,549,125 | 8/1996 | White . |
| 5,568,819 | 10/1996 | Gentry et al. . |

*Primary Examiner*—Stanley S. Silverman
*Assistant Examiner*—Dionne A. Walls
(74) *Attorney, Agent, or Firm*—Kirkpatrick & Lockhart LLP

(57) ABSTRACT

A filter element for reducing or eliminating the harmful vapor phase components of air or smoke. The filter element includes a first section and a second section. The first section is positioned relative to and in fluid communication with the second section and contains an activated carbon fabric. The second section contains a mixture of catalytic activated carbon and coconut activated carbon.

23 Claims, 2 Drawing Sheets

FILTER ELEMENT

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is directed, generally, to a filter element and, more particularly, to a filter element that removes harmful substances from air or smoke.

2. Description of the Invention Background

Over the years, substantial progress has been made in the United States in reducing the prevalence of cigarette smoking. Public awareness through advertising and the like has had a significant impact on encouraging those who would otherwise have started to smoke to not do so. For those who currently smoke, the broader availability and promotion of treatments for tobacco dependence, such as nicotine gum and patches, have provided methods that lead to smoking cessation. However, despite more than 30 years of progress in reducing the prevalence of smoking in the United States, approximately 48 million adult Americans, nearly one quarter of the adult population, continue to smoke.

Furthermore, it is estimated that roughly two billion people worldwide choose to smoke. Accordingly, societal health consequences and support for smoking prevention and cessation measures is clearly a global issue.

Most, if not all, physicians would agree that the most effective approach to reduce or eliminate the adverse health consequences associated with smoking is to stop, or never begin, smoking. From a practical standpoint, however, it is unlikely that smoking can be universally eliminated in the near term. Accordingly, even with the advances made in reducing the prevalence of smoking, the scope of tobacco dependence demands that physicians and scientists explore alternative treatment strategies that help reduce the harmful effects that impact those who choose to smoke.

A variety of strategies have been suggested to reduce the harmful effects of smoking. One common strategy is to construct a more effective filter element that removes the condensable gas phase components from the mainstream smoke prior to inhalation. One simple form of filter element is one that incorporates cellulose acetate tow and carbonaceous material, such as activated carbon, across its longitudinal length. In this form, carbonaceous material is typically spread over the cellulose acetate tow, with the tow acting as an adhesive to retain the carbonaceous material thereon. The tow is gathered and formed in a conventional manner, circumscribed by plug wrap, and cut into appropriate lengths to produce the filter element. The tow is longitudinally aligned in an end-to-end relationship with a tobacco rod and retained thereto using acircumscribing tipping material.

Some multi-sectional filter elements, such as dual-filter segment or triple-filter segment designs, are known to have advantages over single segment filter elements. In the multi-sectional filter element design, more than one segment may perform a separate component removal or airflow function to increase the overall filter effectiveness. For example, one known triple-filter configuration includes a tobacco rod end segment, a center filter segment, and a mouth end segment. The center segment includes a conventional carbonaceous filter material such as gathered carbon paper. The rod end and mouth end filter segments are formed of conventional material such as gathered cellulose acetate web. Passageways extending longitudinally through the filter element are said to direct the aerosol particles of the mainstream smoke through the filter element without physically interacting with the carbonaceous material, while the harmful gas phase components physically and chemically interact with the carbon paper for removal from the mainstream smoke.

As evidenced by the numerous filter element designs that have been proposed, the choice and amount of carbonaceous material and the arrangement of the segments of the multi-sectional filter element have a significant effect on the reduction of the gas phase components from the mainstream smoke. However, these designs may adversely impact the smoking experience by reducing the draw through the filter, or alter the chemical and physical properties of the aerosol particles therein. This latter effect causes the tobacco smoke to have an unpleasant dry or metallic flavor. Accordingly, many conventional filter elements provide only a modest reduction in gas phase components due to the choice of carbonaceous filter materials used therein, the arrangement of the filter segments, or the attempt to not adversely effect the smoking experience.

Despite efforts by those skilled in the art to improve filter elements, the conventional filter element designs have been unable to achieve reduction of gas phase components to near zero levels, without adversely effecting the smoking experience. Accordingly, a new filter element is needed that will satisfy these requirements.

BRIEF SUMMARY OF THE INVENTION

The present invention solves the above-mentioned problems by providing a new filter element for reducing or eliminating the harmful vapor phase components of air or smoke. The filter element includes a first section and a second section. The second section is positioned relative to and in fluid communication with the first section. The first section contains an activated carbon fabric, and the second section contains a mixture of catalytic activated carbon and coconut activated carbon.

In one form, the filter element includes a third filter section positioned relative to and in fluid communication with the second section. In this form, the first section, the second section, and the third section may, but need not, be positioned in an end-to-end abutting relationship along a common longitudinal axis. Other filter sections known in the art may be positioned between the first, second, and third filter sections to provide enhanced filtering or flavoring properties.

In another form, the present invention may be incorporated into a smoking article such as, for example, a cigarette or cigar. In this form, the filter element of the present invention is positioned in longitudinal abutting relationship with the a tobacco rod, and includes a first segment that contains the activated carbon fabric, and a second segment that contains the mixture of catalytic activated carbon and coconut activated carbon.

The filter element of the present invention achieves near zero gas phase component reduction of many carcinogenic and other harmful gas phase components (volatile and semi-volatile compounds) in air or smoke. In addition, when incorporated into a smoking article, the combination and arrangement of the three activated carbons does not adversely effect the smoking experience.

Those and other advantages and benefits of the present invention will become apparent from the description of the preferred embodiments hereinbelow.

BRIEF DESCRIPTION OF THE SEVERAL VIEWS OF THE DRAWING

The characteristics and advantages of the present invention may be better understood by reference to the accompanying drawings, in which.

DETAILED DESCRIPTION OF THE INVENTION

Figure 1:
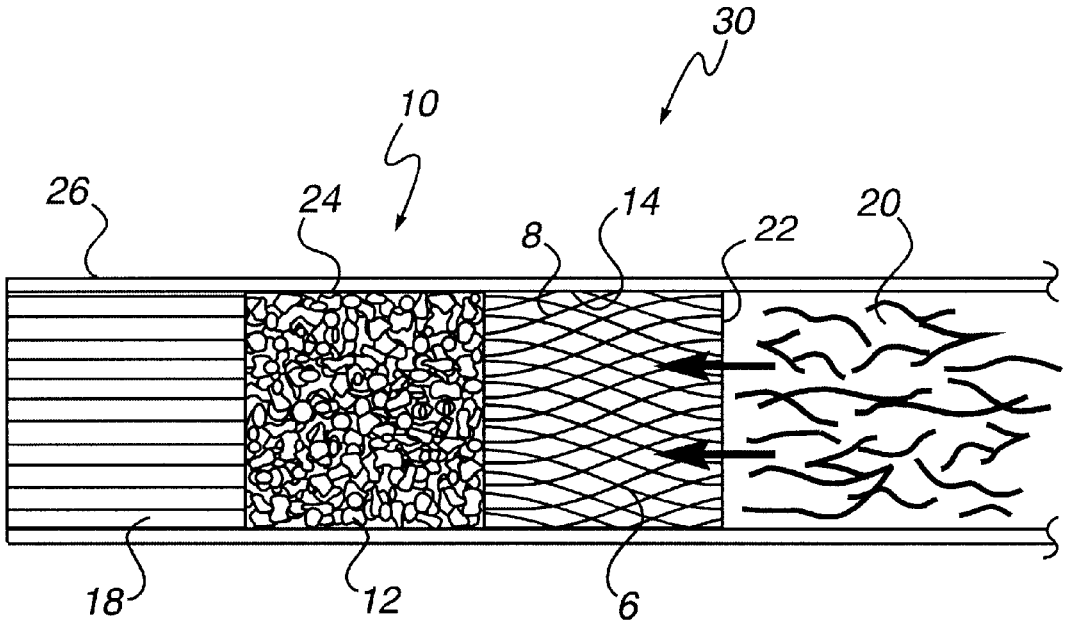
FIG. 1 is a cross-sectional view of one form of the present invention incorporated into a smoking article.

It is to be understood that the Figures and descriptions of the present invention have been simplified to illustrate elements that are relevant for a clear understanding of the present invention, while eliminating, for purposes of clarity, other elements. Those of ordinary skill in the art will recognize that other elements may be desirable in order to implement the present invention. However, because such elements are well known in the art, and because they do not facilitate a better understanding of the present invention, a discussion of such elements is not provided herein.

In the present Detailed Description of the Invention, the invention will be illustrated in the form of a filter element assembly having a particular configuration. To the extent that this configuration gives size and structural shape to the filter element, it should be understood that the invention is not limited to embodiment in such form and may have application in whatever size, shape, and configuration of filter element desired. Thus, while the present invention is capable of embodiment in many different forms, this detailed description and the accompanying drawings disclose only specific forms as examples of the invention. Those having ordinary skill in the relevant art is will be able to adapt the invention to application in other forms not specifically presented herein based upon the present description.

Also, the present invention and devices to which it may be attached may be described herein in a normal operating position, and terms such as upper, lower, front, back, horizontal, proximal, distal, etc., may be used with reference to the normal operating position of the referenced device or element. It will be understood, however, that the apparatus of the invention may be manufactured, stored, transported, used, and sold in orientations other than those described.

The present invention, as described herein, will be generally illustrated in the form of a filter element incorporated into a smoking article that removes harmful components from the gaseous phase of tobacco smoke. It will be understood, however, that the present invention may be used in other forms or embodiments that may not be specifically and expressly described herein. For example, it is contemplated that the present invention may be incorporated into mechanical equipment for clearing harmful substances from air or smoke, or may be used with respirators or other breathing apparatuses to reduce the amount of hazardous materials inhaled from smoke or gas. Accordingly, one skilled in the art will appreciate that the present invention may be incorporated into particulate is removal devices or breathing apparatuses not particularly identified herein.

The term "fluid" as used herein in associated with the phrase "fluid communication" should be understood to be any material or substance that changes shape or direction in response to an external force imposed thereon. As such, this term includes all gases, including the gas phase components contained therein.

Turning now to the drawings, FIG. 1 is a cross-sectional view of one form of the filter element of the present invention wherein a multi-sectional filter element 10 is longitudinally positioned adjacent to, and in abutting relationship with, a tobacco rod 20. In this form, the multi-sectional filter element 10 generally includes a first segment 6, a second segment 12, and a third segment 18.

Figure 3:
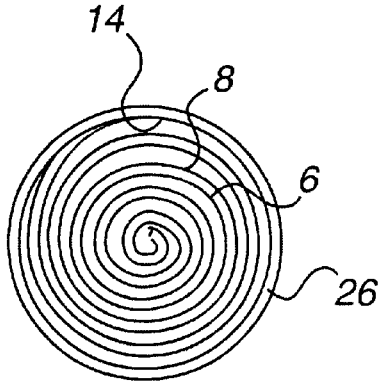
FIG. 3 is a cross section through the line III—III of FIG. 2 showing the wound activated carbon fabric.

The first segment 6 may be longitudinally disposed relative to and in fluid communication with the tobacco rod 20, as illustrated, and may, but need not, be positioned such that the first segment 6 is adjacent to the filter end 22 of the tobacco rod 20 in end-to-end abutting relationship. The first segment 6 includes a cloth-like activated carbon such as, for example, an activated charcoal cloth 8. Activated carbon cloth is commercially available from Calgon Carbon, Pittsburgh, Pa. The activated carbon cloth may be selected from a family of 100 percent activated carbons that are bundles of activated carbon filaments and fibers of approximately 50 microns in diameter that may be constructed in the form of woven or knitted fabric. The cloth 8 is positioned within the first segment to define a tortuous path for the flow of fluid therethrough. The cloth 8 may be wound in a spiral and housed within a thin paper like wrapping material 14 (FIG.3). The activated carbon cloth should have a pH of about 6.4 when added in distilled water.

The first segment 6 may be formed using any filter rod assembly machinery known in the art. The cloth 8 may be integrated into the first segment 6 by winding, folding and/or twisting the cloth 8, as illustrated. The cloth 8 may be integrated into a tubular filter element, circumscribed by a wrapping material 14, such as a paper plug wrap, and cut into appropriate lengths to form the first segment 6. The first segment 6 is preferably equal to or greater than the length of each of the second and third segments. In a cigarette, for example, the length of the first segment 6 may be about 7 mm to 12 mm.

The second segment 12 may be longitudinally disposed relative to and in fluid communication with the first segment 6, as illustrated, and may, but need not, be positioned such that the first segment 6 and the second segment 12 are adjacent and in end-to-end abutting relationship along a common longitudinal axis. The second segment 12 includes a granular carbonaceous mixture such as, for example, a mixture of catalytic activated carbon and coconut activated carbon. The catalytic activated carbon is should have a pH of about 7.0, and the coconut activated carbon should have a pH of about 9.8, when added in distilled water. The catalytic activated carbon may be selected from a family of non-impregnated bituminous-based activated carbons that exhibit both adsorption and catalytic properties for vapor-phase treatment. The catalytic activated carbon may be added in any amount sufficient to reduce the vapor phase components in the tobacco smoke, such as, for example in an amount ranging from 80–100 mg. Although any suitable catalytic activated carbon may be used, the second segment 12 may include catalytic activated carbon manufactured by Calgon Carbon Corporation, Pittsburgh, Pa. under the trademark Centaur®. In like manner, the coconut activated carbon may be added in any amount sufficient to reduce the vapor phase components in the tobacco smoke, such as, for example in an amount ranging from 40–60 mg. Although any suitable coconut-based activated carbon may be used, the second segment 12 may include, for example, coconut activated carbon used for vapor treatment that is manufactured by Calgon Carbon Corporation, Pittsburgh, Pa.

The second segment 12 may be formed using any known filter rod assembly machinery known in the art. For example, integration of the granular carbonaceous material into the filter element 10 may be accomplished by mixing the foregoing amounts of catalytic activated carbon and coconut activated carbon for insertion of the loose granular mixture between the first segment 6 and the third segment 18. In this form, the carbonaceous mixture is held in place by the first segment 6, the second segment 18, and the tipping material 26. The carbonaceous mixture may also be spread over filter material such as, for example, cellulose acetate tow. In this form, the tow material acts as an adhesive to retain the carbonaceous material thereon. When cellulose acetate is used, the cellulose acetate and carbonaceous mixture are gathered and formed into a tubular filter element, circumscribed by a wrapping material, such as a paper plug wrap, and cut into appropriate lengths to form the second segment. For cigarettes, the typical length of the second segment 12 is about 7 mm.

The third segment 18 may be a tow filter positioned at the mouth end of the filter element. The third segment 18 may be longitudinally disposed relative to and in fluid communication with the second segment 12 and may, but need not, be positioned such that the second segment 12 and the third segment 18 are adjacent and in end-to-end abutting relationship along a common axis. Any filter material known in the art may be used to form the third segment 18 such as, for example, gathered cellulose acetate tow, plasticized cellulose acetate tow, gathered polyester web, gathered polypropylene web, or polypropylene tow. The third segment 18 may be formed using any known filter rod assembly machinery known in the art. For example, cellulose acetate may be gathered and formed into a tubular filter element, circumscribed by a wrapping material, such as a paper plug wrap, and cut to an appropriate length to form the third segment 18. For a cigarette, the typical length of the third segment 18 is about 7 mm.

The filter element 10 of the present invention may be assembled using any plug tube combining techniques known in the art. For example, the carbonaceous mixture that forms the second segment 12 may be longitudinally disposed relative to the first segment 6 and may be positioned such that the first segment 6 and the second segment 12 are adjacent and in end-to-end abutting relationship. In like manner, the third segment 18 may be longitudinally disposed relative to the second segment 12 and may be positioned such that the second segment 12 and the third segment 18 are adjacent and in end-to-end abutting relationship. The three filter segments may be held together using circumscribing outer wrapping material 24, such as paper plug wrap, to form the filter element 10.

The smoking article 30 of the present invention may comprise the filter element 10 and the tobacco rod 20. The filter element 10 may be positioned adjacent to the filter end 22 of the tobacco rod 20 so that the filter element 10 and the tobacco rod 20 are in an end-to-end coaxial abutting relationship. The filter element 10 may be attached at end 22 of the tobacco rod 20 by tipping material 26 that circumscribes both the entire length of the filter element 10 and the adjacent region of the tobacco rod 20. The tipping material 26 may fasten the filter element 10 to the tobacco rod 20 by any means known in the art, such as, for example, by applying adhesive to the outer surface of the wrapping material of both the tobacco rod and the filter element and securing the inner surface of the tipping material thereto.

Figure 2:
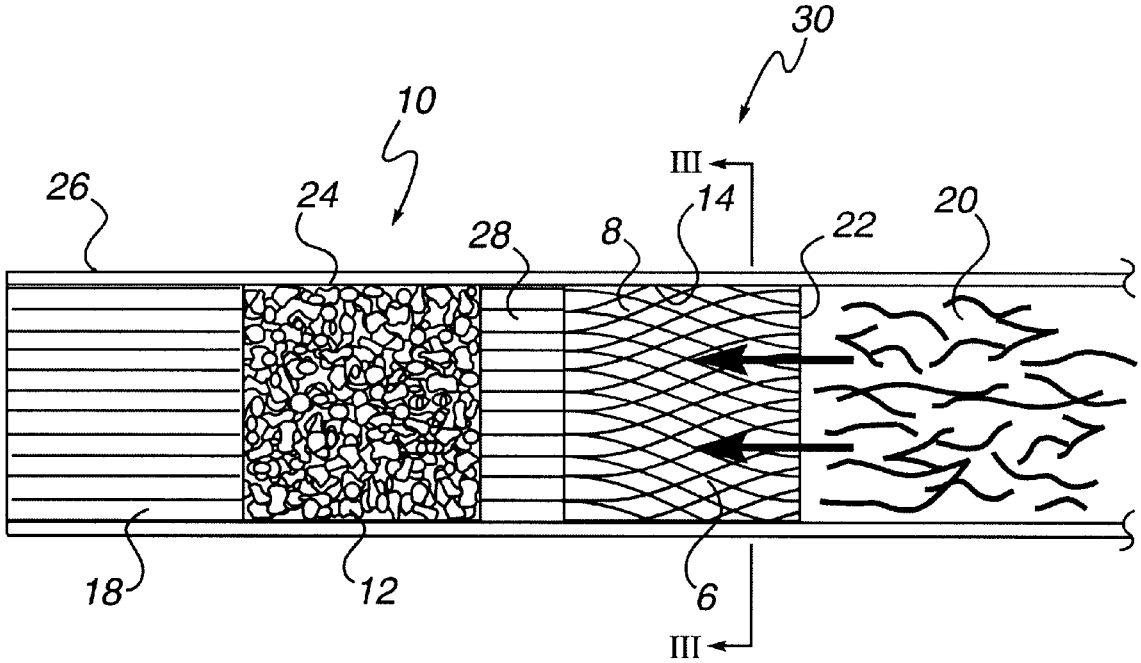
FIG. 2 is a cross-sectional view of an alternate form of the embodiment illustrated in FIG. 1.

As illustrated in FIG. 2, it is contemplated that the first segment 6, the second segment 12, and the third segment 18 may, but need not, be positioned in an end-to-end abutting relationship. Other filter segments known in the art may be positioned between the tobacco rod 10 and the first segment 6, the first segment 6 and the second segment 12, and the second segment 12 and the third segment 18, to provide, for example, additional airflow, flavoring, or gas component removal properties. For example, a conventional cellulose acetate filter segment 28 incorporating a flavoring agent may be positioned between the first segment 6 and the second segment 12 to provide added flavor to the tobacco smoke passing therethrough. Accordingly, although the first segment 6, the second segment 12, and the third segment 18 should be sequentially ordered as described above, other filter segments known in the art may be positioned therebetween.

It is also contemplated that the first, second, and third filter segments 6, 12, 18 of the present invention may include additives or flavoring agents designed to enhance the smoking experience. For example, sugars may be added to is the filter segments 6, 12, 18 of the present invention to provide a flavoring effect to the inhaled smoke.

In operation, as the tobacco in the tobacco rod 20 burns toward the filter element 10, aerosol (e.g. smoke) formed from the combustion thereof is drawn from the tobacco rod 20 through the filter element 10. As the aerosol travels through the filter element 10, the aerosol contacts and reacts with the activated carbon cloth 8 in the first segment 6. The arrangement of the cloth 8 directs the aerosol along a path toward the remaining segments for effective contact therewith. As the aerosol passes through the second segment 12, the aerosol contacts and reacts with the mixture of the catalytic activated carbon and the coconut activated carbon contained therein. The user inhales the treated aerosol through the third segment 18.

As illustrated hereinbelow, the filter element 10 of the present invention achieves near zero gas phase component reduction of many carcinogenic and other harmful gas phase components (volatile and semi-volatile compounds) in tobacco smoke. In addition, when used in a tobacco filter element, the combination and arrangement of the three activated carbons does not adversely effect the smoking experience, such as the flavoring taste, of the tobacco smoke.

The cloth, catalytic, and coconut activated carbons have different physical and chemical properties, such as pH values, that are particularly effective when combined and used in sequence. This combination provides an effective multi-particulate arrangement that substantially reduces vapor cytotoxins, irritants, and free radicals in air and smoke, such as, for example, tobacco smoke. The present invention provides significant reductions of these harmful components that would, otherwise, be inhaled.

The following example is for illustration only and is not meant to limit the scope of the appended claims.

EXAMPLE

The efficacy of the present invention was evaluated in terms of its chemistry (i.e. specific chemical levels) and biology, where the effect of toxicants on biological systems are assessed. For these evaluations, the present invention was used in the form of a cigarette filter element. Five series of measurements were performed and the amount of the harmful substances was generated from the smoking of 20 throng of about 400 cigarettes. In these measurements, the capacity of the present invention filter was tested and compared to the capacity of a conventional single segment reference filter element, formed of cellulose acetate, to determine the reduction of the harmful substances contained in cigarette smoke. Measurements were performed using GC-FID (PERKIN ELMER), GC-NPD (PERKIN ELMER), and GC-UV (Inscan) instruments.

The results of the test indicate that approximately 1462.12 μg of harmful components passed through, and were not retained by, the reference acetate filter versus only approximately 49.56 μg of the same compounds that passed through the filter of the present invention. In addition, it was determined that the relative bonding capacity of the filter element of the present invention is 54 times higher as compared to the conventional filter. Also, it was determined the filter element of the present invention is 20 times more efficient than the conventional filter, and the reduction of the measured compounds passing through the filter of the present invention is at a level of about zero emission (99.7%).

As illustrated in the Table below, the test results indicated that the filter element of the present invention reduced a significant number of the harmful and toxic components from the tobacco smoke when compared to the conventional reference filter element. These components include aldehydes (5,6) (acetaldehyde, isobutyraldehyde, formaldehyde) acrolein, acetone, isoprene, diens (1,3-pentadiene), 2-butanone, benzene, methacrolein, butadiene, 2,5 dimethylfurane (2,5 DMF), ethylbenzene, M-xylene, hydrogen cyanide, nitrites (acetonitrile, acetylonitrile, propionitrile, methacrylonitrile, isobutyronitrile), toluene, free radicals, methanothiol, nitrogen monoxide, peroxides, hydrogen sulfide, ammonia, and dimethylnitrosamine.

TABLE

PERCENT OF HAZARDOUS SUBSTANCES REDUCED BY THE FILTER ELEMENT OF THE PRESENT INVENTION

| COMPOUND | REFERENCE FILTER | PRESENT INVENTION FILTER | % REDUCTION |
|---|---|---|---|
| | GC - FID (PERKIN ELMER) | | |
| | μg/cigarette | μg/cigarette | |
| Acetaldehyde | 834.27 | 28.88 | 96.5% |
| Isoprene | 520.25 | 7.88 | 98.5% |
| Acetone | 369.30 | 2.26 | 99.4% |
| Methanol | 346.63 | 8.41 | 97.6% |
| 2-Butanone | 108.53 | 0.00 | 100.0% |
| Toluene | 89.13 | 0.00 | 100.0% |
| Propanal | 85.04 | 0.92 | 98.9% |
| Furane | 85.11 | 4.40 | 94.8% |
| Benzene | 59.80 | 0.00 | 100.0% |
| Acrolein | 92.75 | 0.86 | 99.1% |
| 2,5 DMF | 58.62 | 0.00 | 100.0% |
| Isobutyraldehyde | 35.98 | 0.00 | 100.0% |
| 1,3 Pentadiene | 14.12 | 0.00 | 100.0% |
| M-xylene | 30.25 | 0.00 | 100.0% |
| Ethylbenzene | 14.18 | 0.00 | 100.0% |
| Methacrolein | 8.55 | 0.00 | 100.0% |
| | GC - NPD (PERKIN ELMER) | | |
| | μg/cigarette | μg/cigarette | |
| HCN (μV*s) | 9.30E + 08 | 1.21E + 06 | 99.9% |
| Acetonitrile | 7.86E + 01 | 1.74E + 00 | 97.8% |
| Propionitrile | 1.51E + 01 | 0.00 | 100.0% |
| Acrylonitrile | 9.83E + 00 | 0.00 | 100.0% |
| Isobutyronitrile | 6.22E + 00 | 0.00 | 100.0% |
| Methacrylonitrile | 2.30E + 00 | 0.00 | 100.0% |
| | GC - UV (INSCAN AB) | | |
| | peak area | peak area | |
| Methanethiol | 0.258 | 0.093 | 64.0% |
| Butadiene | 0.343 | 0.098 | 71.4% |
| Hydrogen sulfide | 0.054 | 0.011 | 79.6% |
| Nitrogen oxide | 0.073 | 0.037 | 49.3% |
| | GC - MS (Hewlett Packard) | | |
| | μg/cigarette | μg/cigarette | |
| Naphthalene | 420.0 | 29.5 | 93.0% |
| Acenaphthalene | 80.6 | 33.9 | 57.9% |
| Acetaphthene | 46.2 | 21.4 | 53.7% |
| Fluorene | 199.0 | 128 | 35.7% |
| Phenanthrene | 156.0 | 118 | 24.4% |

Although the foregoing description has necessarily presented a limited number of embodiments of the invention, those of ordinary skill in the relevant art will appreciate that various changes in the components, details, materials, and process parameters of the examples that have been herein described and illustrated in order to explain the nature of the invention may be made by those skilled in the art, and all such modifications will remain within the principle and scope of the invention as expressed herein in the appended claims. For example, particular detail directed to the application of the present invention for use as a tobacco filter element has been presented. It will be understood by those skilled in the art that the particular description and advantages of the present invention as set forth herein are illustrative only, and that other uses and advantages may be employed to reduce the harmful effects of vaporous components of air or smoke. All such additional applications of the invention remain within the principle and scope of the invention as embodied in the appended claims.

What is claimed is:

1. A filter element, comprising:

a first filter section, said first section containing an active carbon fabric; and a second filter section positioned relative to and in fluid communication with said first section, said second section containing a mixture of catalytic activated carbon and coconut activated carbon.

2. The filter element of claim 1, wherein said active carbon fabric has a pH of about 6.4, said catalytic activated carbon has a pH of about 7.0, and said coconut activated carbon has a pH of about 9.8, when added in distilled water.

3. The filter element of claim 1, wherein said active carbon fabric is positioned within said first section to define a tortuous path for the flow of fluids therethrough.

4. The filter element of claim 1, further comprising a third filter section positioned relative to and in fluid communication with said second section.

5. The filter element of claim 4, wherein said third section is formed of a tow material selected from the group consisting of gathered cellulose acetate tow, plasticized cellulose acetate tow, gathered polyester web, gathered polypropylene web, or polypropylene tow.

6. The filter element of claim 4, wherein the first, second and third sections are aligned along a common axis and the first section has a length equal to or greater than the length of each of the second and third sections.

7. The filter element of claim 1, wherein the filter element is a tobacco filter, and said first section is in fluid communications with a tobacco rod.

8. The filter element of claim 7, wherein said first section abuts said second section.

9. The filter element of claim 8, further comprising a third section aligned coaxially with said first and second sections in an abutting relationship relative to said second section.

10. The filter element of claim 1, wherein the catalytic activated carbon is present in an amount ranging from 80–100 mg and the coconut activated carbon is present in an amount ranging from 40–60 mg.

11. A filter element, comprising:

a first filter segment, said first segment containing an active carbon fabric;

a second filter segment positioned relative to and in fluid communication with said first segment, said second segment containing a mixture of catalytic activated carbon and coconut activated carbon; and a third filter segment positioned relative to and in fluid communication with said second segment.

12. The filter element of claim 11, wherein said first, second and third filter segments are aligned on a common longitudinal axis and said second segment is position intermediate said first and third segments.

13. The filter element of claim 11, wherein said third segment is formed of a tow material selected from the group consisting of gathered cellulose acetate tow, plasticized cellulose acetate tow, gathered polyester web, gathered polypropylene web, or polypropylene tow.

14. The filter element of claim 11, wherein the filter element is coaxially aligned in an abutting relationship with a tobacco rod.

15. The filter element of claim 11, wherein the catalytic activated carbon is present in an amount ranging from 80–100 mg and the coconut activated carbon is present in an amount ranging from 40–60 mg.

16. The filter element of claim 15, wherein the first segment ranges from 7–12 mm in length, said second segment is about 7 mm in length, and said third segment is about 6 mm in length.

17. The filter element of claim 11, wherein said carbon fabric has a pH of about 6.4, said catalytic activated carbon has a pH of about 7.0, and said coconut activated carbon has a pH of about 9.8, when added in distilled water.

18. A smoking article, comprising:

a tobacco rod;

a filter element, said filter element positioned in longitudinal abutting relationship with said tobacco rod, said filter element having a first segment and a second segment, and wherein said first segment is postponed in fluid communication with said tobacco rod and contains an active carbon fabric; and said second segment is positioned in fluid communication with said first segment and contains a mixture of catalytic activated carbon and coconut activated carbon.

19. The smoking article of claim 18, further comprising a third segment, in fluid communication with said second segment, said third segment formed of a tow material selected from the group consisting of gathered cellulose acetate tow, plasticized cellulose acetate tow, gathered polyester web, gathered polypropylene web, or polypropylene tow.

20. The smoking article of claim 19, wherein said first, second and third segments are positioned sequentially along a common longitudinal axis.

21. The smoking article of claim 19, wherein the catalytic activated carbon is present in an amount ranging from 80–100 mg and the coconut activated carbon is present in an amount ranging from 40–60 mg.

22. The smoking article of claim 19, wherein the first segment is equal to or greater in length than each said second and third segments.

23. The smoking article of claim 18, wherein said carbon fabric has a pH of about 6.4, said catalytic activated carbon has a pH of about 7.0, and said coconut activated carbon has a pH of about 9.8, when added in distilled water.

* * * * *